United States Patent [19]

Friend

[11] 4,314,426

[45] Feb. 9, 1982

[54] SMOOTHING AND CLEANING OF MOLDED CERAMICS

[76] Inventor: Jack W. Friend, 3509 W. National Ave., Milwaukee, Wis. 53215

[21] Appl. No.: 219,539

[22] Filed: Dec. 23, 1980

[51] Int. Cl.[3] ..... B24D 15/00

[52] U.S. Cl. ..... 51/393; 15/209 D; 15/210 R; 339/29 R

[58] Field of Search ..... 51/382–387, 51/392, 393; 145/33 R; 30/115, 116; 15/209 R, 209 D, 210 R; 339/29 R, 29 B, 261

[56] References Cited

U.S. PATENT DOCUMENTS

| | | | |
|---|---|---|---|
| 2,132,889 | 10/1938 | Ayres | 51/383 |
| 2,332,307 | 10/1943 | Dennis | 30/116 |
| 2,446,653 | 8/1948 | Kelly | 51/393 |
| 3,874,126 | 4/1975 | Catlin | 51/393 |
| 3,936,121 | 2/1976 | Leinberger | 339/29 B |

FOREIGN PATENT DOCUMENTS

| | | | |
|---|---|---|---|
| 531505 | 10/1921 | France | 145/33 R |

*Primary Examiner*—Harold D. Whitehead
*Attorney, Agent, or Firm*—Andrus, Sceales, Starke & Sawall

[57] ABSTRACT

A smoothing and cleaning tool for molded ceramics comprises an elongated main body of spring wire having reverse bends at its ends to form a pair of spaced opposed springable legs which are normally parallel to the main tool body. Fastening devices are mounted on the leg ends for securely attaching to the opposite ends of a flexible elongated abrasive cleaning pad which is freely suspended therebetween in a taut condition and which is substantially spaced from and parallel to the main tool body. When the tool is held in the hand and the pad rubbed against the ceramic article for smoothing and cleaning, the tool legs as well as the fastening devices and pad ends springingly move toward the main tool body in an amount depending upon the extent of pressure applied. The direct pressure applied to the freely suspended pad is thus absorbed by the springable legs through the fastening devices.

4 Claims, 3 Drawing Figures

SMOOTHING AND CLEANING OF MOLDED CERAMICS

U.S. PRIOR ART OF INTEREST

| Inventor | U.S. Pat. No. | Issue Date |
|---|---|---|
| Pataki | 1,660,351 | Feb. 28, 1928 |
| Walker | 2,529,434 | Nov. 7, 1950 |
| Thielen | 4,071,983 | Feb. 7, 1978 |

BACKGROUND AND SUMMARY OF THE INVENTION

This invention relates to smoothing and cleaning of molded ceramics, such as clay and the like.

In the manufacture of ceramic articles such as cups, vases and the like, the article is often first formed in a mold from soft material. After release from the mold, the article is permitted to partially harden, is then smoothed and cleaned, and is finally fired in a kiln.

Smoothing and cleaning is necessary to remove the mold seam as well as any rough spots which usually occur upon molding of items of this type. In addition, it may be desired to round sharp corners such as may be present at the rim of a drinking cup. All of this must be done while the ceramic article is only semi-hard and prior to firing in a kiln.

Heretofore, when such smoothing and cleaning has been performed by hand, the worker has usually held an abrasive pad in his hand and pressed the pad against the semi-hard ceramic article with his fingers and then rubbed back and forth on the article. Unfortunately, most workers do not have adequate control of finger pressure in such an operation. It has been found that the relatively high pressure in pounds per square inch applied by the finger tips through the abrasive pad may cause the article to break.

Tools to assist in manual cleaning of objects have of course long been known. The above-identified patents disclose several types of such tools.

U.S. Pat. No 1,660,351 discloses a hand tool for holding a cleaning sponge for fabrics, but the tool includes a rigid backing plate and spring arms extending into the sponge. If such a tool was utilized to smooth and clean semi-hard ceramic articles, the sponge would have to be compressed substantially to provide sufficient pressure, causing the spring arms to interfere with the smoothing operation. Furthermore, the rigid backing plate would be apt to cause excessive pressure to be applied to the ceramic article and thereby cause breakage thereof, just as in the case of finger tips.

U.S. Pat. No. 2,529,434 discloses a holder for shredded metal, with the tool having spring metal arms supporting the shredded metal. However, the arms and especially the central mounting arrangement would also cause undue pressure to be applied to a semi-hard ceramic article if the worker did not have perfect hand pressure control. There would still be substantial danger of article breakage.

U.S. Pat. No. 4,071,983 discloses a cleaning pad holder for griddles, which would imply the usage of high pressure. This holder also has extensive backing means for the pad to enable sufficient pressure to be applied to remove baked-on material from a griddle. If used for smoothing and cleaning semi-hard ceramic articles, the danger of article breakage would be very high.

The present invention substantially reduces the aforementioned problem of breakage and provides a simple yet unique hand tool for smoothing and cleaning of molded ceramic articles.

In accordance with the various aspects of the inventive concept, the tool comprises an elongated main body of spring wire having reverse bends at its ends to form a pair of spaced opposed springable legs which are normally parallel to the main tool body. Fastening devices are mounted on the leg ends for securely attaching to the opposite ends of a flexible elongated abrasive cleaning pad which is freely suspended therebetween in a taut condition and which is substantially spaced from and parallel to the main tool body. When the tool is held in the hand and the pad rubbed against the ceramic article for smoothing and cleaning, the tool legs as well as the fastening devices and pad ends springingly move toward the main tool body in an amount depending upon the extent of pressure applied. The direct pressure applied to the freely suspended pad is thus absorbed by the springable legs through the fastening devices.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
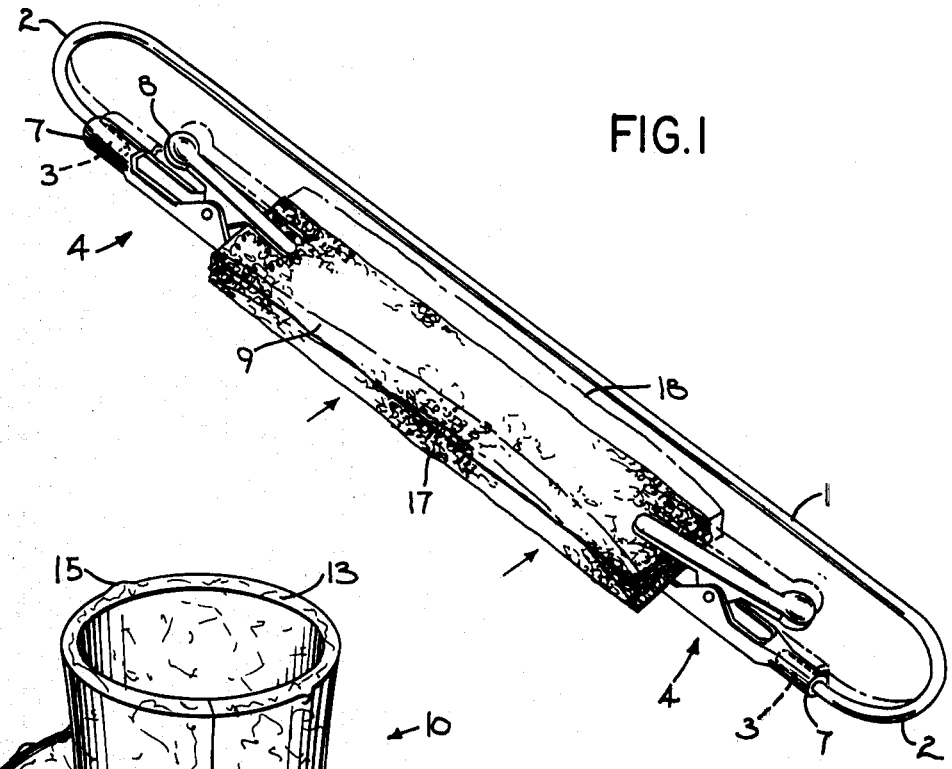
FIG. 1 is a perspective view of a smoothing and cleaning tool for molded ceramics which is constructed in accordance with the concepts of the invention, and showing two conditions thereof.

As shown in the drawings, the apparatus of the invention comprises an elongated rod or body 1 of spring wire such as 9 guage steel, the ends of which are formed into reverse bends 2 to thus form a pair of spaced opposed springable stub legs 3 which, as shown in full lines in FIG. 1, are normally disposed in general parallelism with body 1.

Figure 2:
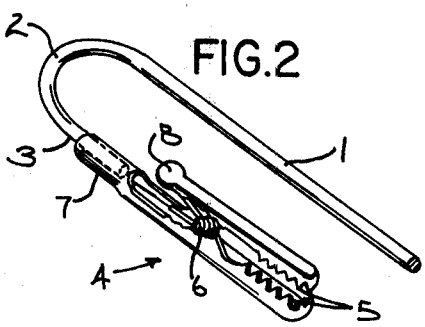
FIG. 2 is an enlarged fragmentary perspective view of one end of the tool, with parts broken away.

The terminous portions of legs 3 are provided with fastening devices. For this purpose, and in the present embodiment best shown in FIG. 2, each device comprises an alligator clip 4 having a pair of jaws 5 which are biased toward closed position by a spring 6. Clip 4 is attached to its respective leg 3 by a clamp portion 7, and is manually actuated to release jaws 5 by pressing on an enlarged outer end portion 8 of one of the jaw ends.

A flexible elongated abrasive pad 9 is clamped at its ends by clips 4 and extends between legs 3 to form a continuation of the spring and a closed loop with the tool. Pad 9 may be made from any suitable material such as plastic, as in the well-known kitchen scrubbing pad marketed under the trademark "Dobie" and distributed by Purex Corporation. As shown in full lines in FIG. 1, pad 9 is held in taut condition by clips 4 and is freely suspended therebetween and spaced from and in parallelism with elongated body 1.

The assembly of the invention is adapted particularly for smoothing and cleaning of semi-hardened molded ceramic articles, such as a hollow jug 10 shown in FIG.

3. Jug 10 is shown as having a circular body portion 11 with a handle 12 and an upper rim or lip 13. Furthermore, due to its having been molded, a mold seam 14 extends upwardly along the exterior of body portion 10, and a plurality of irregularities or bumps 15 exist on the surface of body portion 10, handle 12 and lip 13. In addition, lip 13 is shown as having a sharp edge.

The device of the invention is primarily designed for the purpose of manually removing seam 14 and bumps 15, as well as for rounding off lip 13 prior to firing of jug 10 in a kiln.

Figure 3:
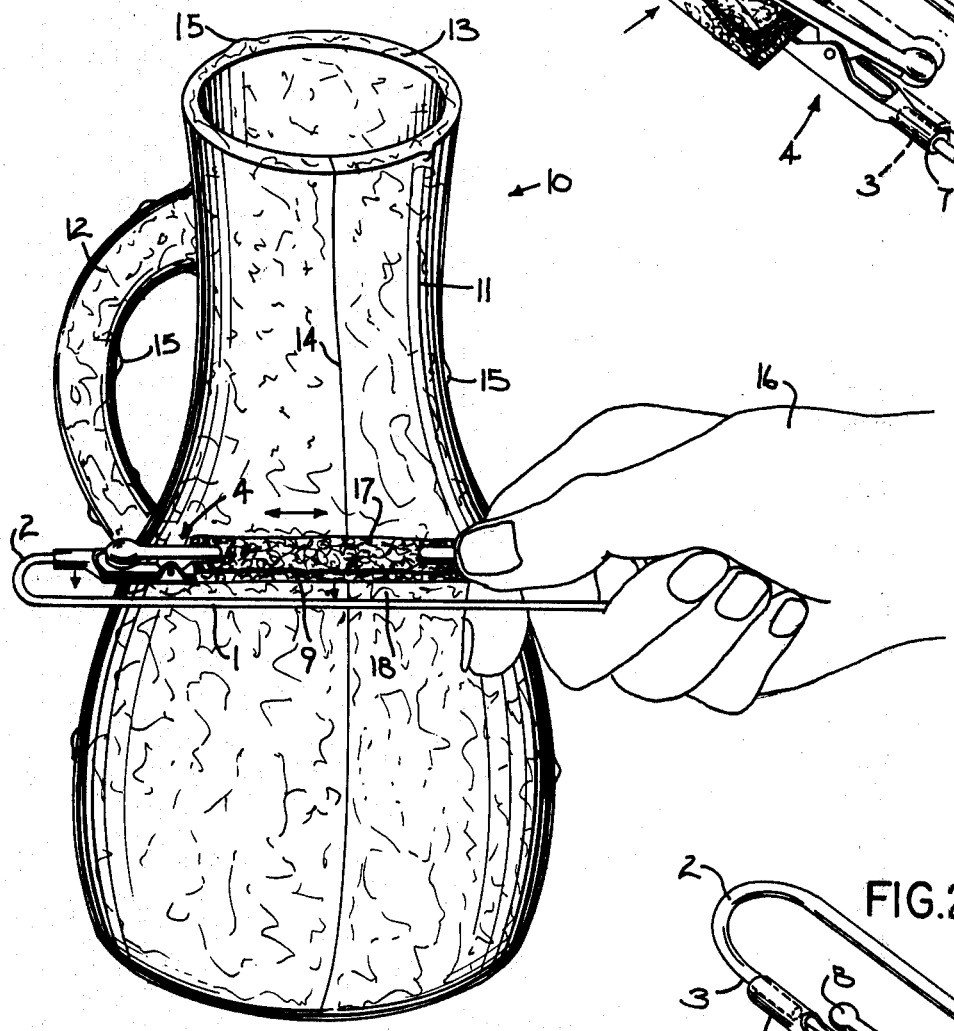
FIG. 3 is a perspective view showing use of the tool in connection with a molded ceramic article.

As best shown in FIG. 3, the tool is grasped by the worker's hand 16 so that the exposed outer edge 17 of pad 9 is in engagement with jug 10 and with the tool positioned so that body 1 and legs 3 are disposed in a plane generally perpendicular to the jug surface. As the worker presses the tool inwardly against jug 10 and provides a back-and-forth reciprocated smoothing and cleaning movement, the pressure will cause freely suspended pad 9 to deform outwardly in the space 18 between the pad and body 1. This deformation causes clips 4 to absorb the pressure at the pad ends and to carry spring legs 3 outwardly and toward body 1. See the phantom showing of FIG. 1 and the arrows in FIGS. 1 and 3.

The greater the pressure applied by the worker, the farther clips 4 and legs 3 will carry the ends of pad 9 away from the surface of jug 10 to thereby adjust the net pressure applied in the smoothing and cleaning operation.

The device of the invention provides a simple and inexpensive means for manually smoothing and cleaning portions of a ceramic article, while substantially reducing the danger of article breakage. Various modes of carrying out the invention are contemplated as being within the scope of the following claims particularly pointing out and distinctly claiming the subject matter which is regarded as the invention.

I claim:

1. Apparatus for manually smoothing and cleaning semi-hardened ceramic articles prior to firing thereof in a kiln, comprising:

(a) an elongated body of spring material, (b) said body being formed at its ends into reverse bends forming a pair of spaced opposed springable stub legs normally disposed generally parallel to said body, (c) fastening devices disposed on the terminus portions of said legs, (d) a flexible elongated abrasive pad attached by said fastening devices between said legs so that the said pad is freely suspended therebetween in taut condition and is disposed in spaced parallelism with said body, (e) said fastening devices and said stub legs forming means to springingly absorb pressure applied to the said pad when the latter is pressed into engagement with a said ceramic article and a reciprocating smoothing and cleaning movement applied.

2. The apparatus of claim 1 wherein said fastening devices and said stub legs also provide means to adjust the net pressure applied to the said ceramic article during smoothing and cleaning engagement of the article by the said pad.

3. The apparatus of claim 1 or 2 wherein the said pad forms, together with said base, said stub legs and said fastening devices, a springable closed loop tool.

4. The apparatus of claim 3 in which said fastening devices comprise alligator clips having spring biased jaws for clamping the said pad in freely suspended position.

* * * * *